US007626325B2

(12) United States Patent
Murata et al.

(10) Patent No.: US 7,626,325 B2
(45) Date of Patent: Dec. 1, 2009

(54) IMAGE DISPLAY APPARATUS

(75) Inventors: Hirotaka Murata, Fukaya (JP); Keiji Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 374 days.

(21) Appl. No.: 11/768,245

(22) Filed: Jun. 26, 2007

(65) Prior Publication Data

US 2007/0246747 A1 Oct. 25, 2007

Related U.S. Application Data

(63) Continuation of application No. PCT/JP2005/023065, filed on Dec. 15, 2005.

(30) Foreign Application Priority Data

Dec. 27, 2004 (JP) ..... 2004-376874

(51) Int. Cl.
*H01J 1/62* (2006.01)
*H01J 63/04* (2006.01)

(52) U.S. Cl. ..... 313/496; 313/422; 313/554; 313/495

(58) Field of Classification Search ..... 313/495, 313/496, 497, 422, 310, 504, 553, 554, 558; 315/169.1, 169.2, 169.3
See application file for complete search history.

(56) References Cited

U.S. PATENT DOCUMENTS

| | | | | |
|---|---|---|---|---|
| 5,592,056 | A | 1/1997 | Peyre et al. | |
| 2005/0179398 | A1 | 8/2005 | Onishi | |
| 2006/0061258 | A1 * | 3/2006 | Tagawa et al. | 313/496 |
| 2006/0103294 | A1 * | 5/2006 | Suzuki et al. | 313/496 |
| 2006/0170008 | A1 * | 8/2006 | Konishi | 257/236 |
| 2008/0122339 | A1 * | 5/2008 | Murata et al. | 313/495 |

FOREIGN PATENT DOCUMENTS

| | | | |
|---|---|---|---|
| JP | 8-236047 | A | 9/1996 |
| JP | 10-326583 | | 12/1998 |
| JP | 2000-251797 | | 9/2000 |
| JP | 2001-243893 | | 9/2001 |
| JP | 2003-68237 | | 3/2003 |
| JP | 2004-47408 | A | 2/2004 |
| JP | 2004-158232 | | 6/2004 |
| JP | 2004-335346 | | 11/2004 |
| JP | 2005-235470 | A | 9/2005 |
| JP | 2005-268109 | A | 9/2005 |
| WO | WO 03/019608 | A1 * | 3/2003 |

* cited by examiner

*Primary Examiner*—Peter J Macchiarolo
*Assistant Examiner*—Glenn Zimmerman
(74) *Attorney, Agent, or Firm*—Fitzpatrick, Cella, Harper & Scinto

(57) ABSTRACT

An image display apparatus includes a front substrate, and a rear substrate opposed to the front substrate. The front substrate has phosphor layers, resistor layers provided between the phosphor layers, a metal-back layer divided into metal-back segments covering the phosphor layers and resistor layers at least in part, and spaced apart by gaps Gx in a first direction intersecting at right angles with a scanning direction and by gaps Gy in a second direction identical to the scanning direction, and a voltage-applying portion which applies a voltage on the metal-back segments. Rx(100)/Rx(1)<Ry(100)/Ry(1) is satisfied, where Rx(V) is a resistance between any two metal-back segments on the sides of a gap Gx, respectively, which is the function of voltage V [V], and Rx(V) is a resistance between any two metal-back segments on the sides of a gap Gy, respectively, which is the function of the voltage V [V].

4 Claims, 4 Drawing Sheets

IMAGE DISPLAY APPARATUS

CROSS-REFERENCE TO RELATED APPLICATIONS

This is a Continuation Application of PCT application No. PCT/JP2005/023065, filed Dec. 15, 2005, which was published under PCT Article 21 (2) in Japanese.

This application is based upon and claims the benefit of priority from prior Japanese Patent Application No. 2004-376874, filed Dec. 27, 2004, the entire contents of which are incorporated herein by reference.

BACKGROUND OF THE INVENTION

1. Field of the Invention

The present invention relates to an image display apparatus, and more particularly to a flat image display apparatus that uses electron-emitting elements.

2. Description of the Related Art

In recent years, flat displays have been developed as next-generation displays, in which a number of electron-emitting elements are arranged and opposed to the phosphor screen. Various types of electron-emitting elements are available. Basically, they perform electric-field emission. Any display using electron-emitting elements is generally called a field-emission display (hereinafter referred to as an FED). Of the various FEDs available, a display that uses surface-conduction electron-emitting elements is called a surface-conduction electron emission display (hereinafter referred to as an SED). Nonetheless, an SED will be referred to as an FED in the present application.

An FED has a front substrate and a rear substrate, which are opposed to each other and spaced apart by a narrow gap of about 1 to 2 mm. These substrates are fused at their peripheral edges, with a rectangular frame-shaped side wall interposed between them. The substrates therefore form a vacuum envelope. The interior of the vacuum envelope is maintained at a high vacuum of about $10^{-4}$ Pa. A plurality of spacers are provided between the substrates, supporting the substrates against the atmospheric pressure applied to them.

On the inner surface of the front substrate, a phosphor screen including red, blue and green phosphor layers is formed. On the inner surface of the rear substrate, a number of electron-emitting elements are provided. These elements emit electrons, which excite the phosphors and make them emit light. On the rear substrate, a number of scanning lines and a number of signal lines are provided, in the form of a matrix. These lines are connected to the electron-emitting elements. An anode voltage is applied to the phosphor screen, accelerating the electron beams emitted from the electron-emitting elements. The electrons thus accelerated impinge on the phosphor screen. The screen therefore emits light, whereby the FED displays an image.

In the FED described above, phosphor of the same type as the one used in the ordinary cathode ray tube is used in order to provide practical display characteristics. Further, the phosphor screen must have an aluminum film called a metal back, which covers the phosphor. In this case, the anode voltage applied to the phosphor screen is preferably at least several kilovolts (kV), or 10 kV or more if possible.

However, the gap between the front substrate and the rear substrate cannot be made so large, in view of the desired resolution and the characteristic of the spacers. The gap is therefore set to about 1 to 2 mm. Hence, an intense electric field is inevitably applied in the gap between the front substrate and the rear substrate in the FED. Consequently, discharge, if any, between these substrates becomes a problem.

If no measures are taken against possible damage due to discharge, the discharge will degrade or destroy the electron-emitting elements, the phosphor screen, the driver IC and the drive circuit. Possible damage to these components will be generally called discharge damage. In any condition where discharge damage may occur, discharge should be avoided, by all means, for a long time in order to make the FED a practical apparatus. This is, however, very difficult to achieve in practice.

It is therefore important to reduce the discharge current to such a level as would cause no discharge damage or would cause but negligibly small discharge damage, even if a discharge takes place. Known as a technique of reducing the discharge current is dividing the metal back into segments. Depending on its configuration, the FED may have a getter layer on the metal back in order to maintain a desired degree of vacuum. In this case, the getter needs to be divided into segments, too. For convenience, terms "metal back dividing" and "divided metal back" will be used hereinafter.

Metal back dividing can be classified mainly into two types. One is one-dimensional dividing, i.e., dividing the metal back, in one direction, into strip-shaped segments. The other is two-dimensional dividing, i.e., dividing the metal back, in two directions, into island-shaped segments. The two-dimensional dividing can reduce the discharge current more than the one-dimensional dividing. Jpn. Pat. Appln. KOKAI Publication No. 10-326583 (hereinafter referred to as Patent Document 1), for example, discloses the basic concept of one-dimensional dividing. Jpn. Pat. Appln. KOKAI Publication No. 2001-243893 (hereinafter referred to as Patent Document 2) and Jpn. Pat. Appln. KOKAI Publication No. 2004-158232 (hereinafter referred to as Patent Document 3) disclose two-dimensional dividing.

If the metal back is divided into segments, it is necessary to provide a path for the beam current, to reduce the luminance decrease to a tolerable level and to prevent discharge due to the potential difference at the gap. In connection with this point, Patent Document 1 and Patent Document 3 disclose a configuration in which a resistance layer is provided between the metal-back segments. Patent Document 2 discloses a configuration in which the metal-back segments are connected to power lines by resistance layers. The technique of providing resistance layers between the metal-back segments is disclosed in Jpn. Pat. Appln. KOKAI Publication No. 2000-251797, too.

To maintain a sufficient degree of vacuum in the envelope of the FED of the configuration described above, a getter film may be provided on the metal back in some cases. In the two-dimensional dividing, too, a getter film may be divided into segments by using projections and depressions made on and in the surface, as is disclosed in, for example, Jpn. Pat. Appln. KOKAI Publication No. 2003-068237 and Jpn. Pat. Appln. KOKAI Publication No. 2004-335346.

In any conventional configuration in which the metal back is divided into segments, the following three requirements must be accomplished. (1) The discharge current should be equal to or smaller than the tolerance current. (2) The gaps between the metal-back segments should serve as resistors, and the anode current should decrease as the beam current flows through these resistors. (3) No discharge should occur, resulting from the voltage generate in the gaps between the metal-back segments, at the time of discharge.

In the configuration described in, for example, Patent Document 2, wherein the metal-back segments are connected to power lines, respectively, the discharge current may indeed be decreased, but to a limited value. The problems with the prior art, which should be solved, will be explained below, on the assumption that resistor layers are provided between the metal-back segments as is disclosed in Patent Document 1 and Patent Document 3.

The electrical parameter important to the two-dimensional division is resistance Rx between the metal-back segments arranged in X direction and resistance Ry between the metal-back segments arranged in X direction. In a typical rectangular screen that is longer in the horizontal direction than in the vertical direction, the X and Y directions are the major-axis direction and the minor-axis direction, respectively. Nevertheless, the general definition of the X and Y directions will be described later.

In order to achieve the requirement (1) described above, it is advantageous to increase Rx and Ry. To achieve the requirements (2) and (3), it is useful to decrease Rx and Ry. Thus, the requirement (1), on the one hand, and the requirements (2) and (3), on the other, are in a trade-off relation. Inevitably, the discharge current cannot be reduced as much as desired.

Therefore, there has been a demand for a technique that can reduce the discharge current as much as desired.

BRIEF SUMMARY OF THE INVENTION

The present invention has been made to solve the problem described above and its object of the invention is to provide an image display apparatus in which the discharge current can be reduced and which can therefore achieve high performance and can be manufactured at low cost.

The decrease in the discharge current, attained by the two-dimensional dividing, is related in a complex way to various factors such as the luminance, definition degree, lifetime, reliability, mass-productivity and cost of the image display apparatus. Hence, the image display apparatus will achieve higher performance and be made at a lower cost if the discharge current is decreased more than before, overcoming various restrictions.

As the research conducted by the inventors hereof shows, however, the discharge current cannot be sufficiently reduced only if Rx and Ry are optimized, depending upon the specification requirements of the image display apparatus.

According to an aspect of the invention, there is provided an image display apparatus comprising: a front substrate which has a plurality of phosphor layers, resistor layers provided between the phosphor layers, a metal-back layer divided into a plurality of metal-back segments covering the phosphor layers and resistor layers at least in part, and spaced apart by gaps Gx in a first direction X intersecting at right angles with a scanning direction and by gaps Gy in a second direction Y identical to the scanning direction, and voltage-applying means for applying a voltage on the metal-back segments; and a rear substrate which is opposed to the front substrate and on which a plurality of electron-emitting elements are arranged; wherein $Rx(100)/Rx(1)<Ry(100)/Ry(1)$, where Rx(V) is a resistance between any two metal-back segments on the sides of a gap Gx, respectively, which is the function of voltage V[V], and Rx(V) is a resistance between any two metal-back segments on the sides of a gap Gy, respectively, which is the function of the voltage V[V].

According to another aspect of the invention, there is provided n image display apparatus comprising: a front substrate which has a plurality of phosphor layers, resistor layers provided between the phosphor layers, a metal-back layer divided into a plurality of metal-back segments covering the phosphor layers and resistor layers at least in part, and spaced apart by gaps Gx in a first direction X intersecting at right angles with a scanning direction and by gaps Gy in a second direction Y identical to the scanning direction, a getter layer divided into a plurality of getter-layer segments spaced apart by gaps Gxg in the first direction and by gaps Gyg in the second direction, and voltage-applying means for applying a voltage on the metal-back segments; and a rear substrate which is opposed to the front substrate and on which a plurality of electron-emitting elements are arranged;

wherein $Rxg(100)/Rxg(1)<Ryg(100)/Ryg(1)$, where Rxg(V) is a resistance between any two getter-layer segments on the sides of a gap Gxg, respectively, which is the function of voltage V[V], and Rxg(V) is a resistance between any two metal-back segments, respectively, on the sides of a gap Gyg, which is the function of the voltage V[V].

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

FEDs according to embodiments of this invention will be descried, with reference to the accompanying drawings.

Figure 1:
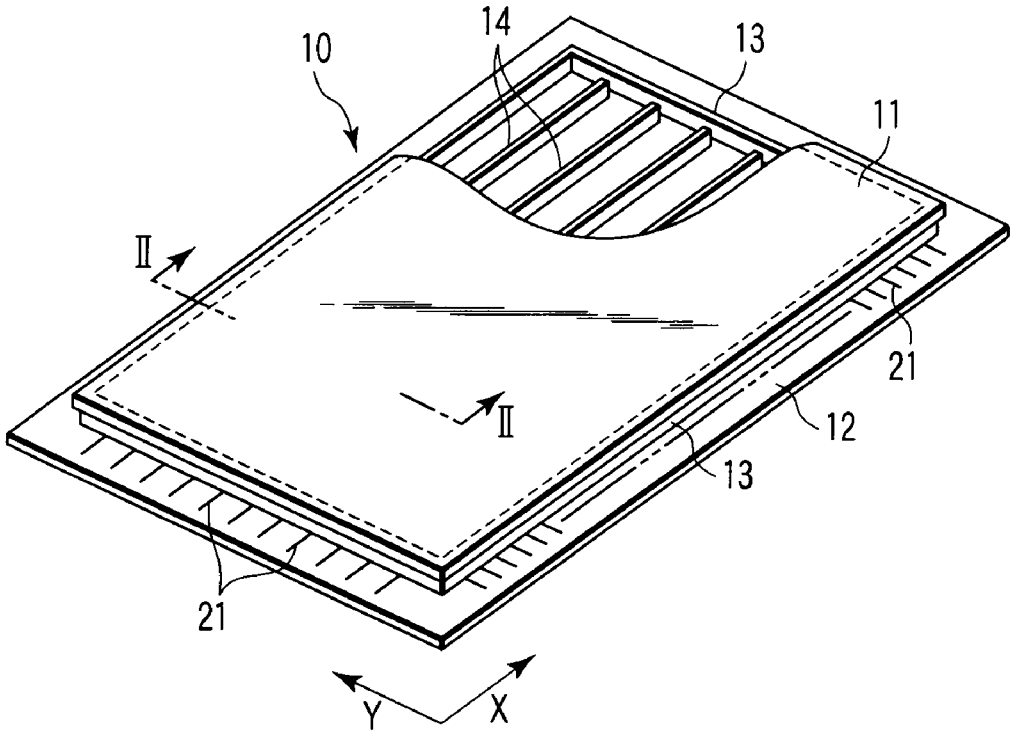
FIG. 1 is a perspective view showing an FED according to a first embodiment of the present invention.
Figure 2:
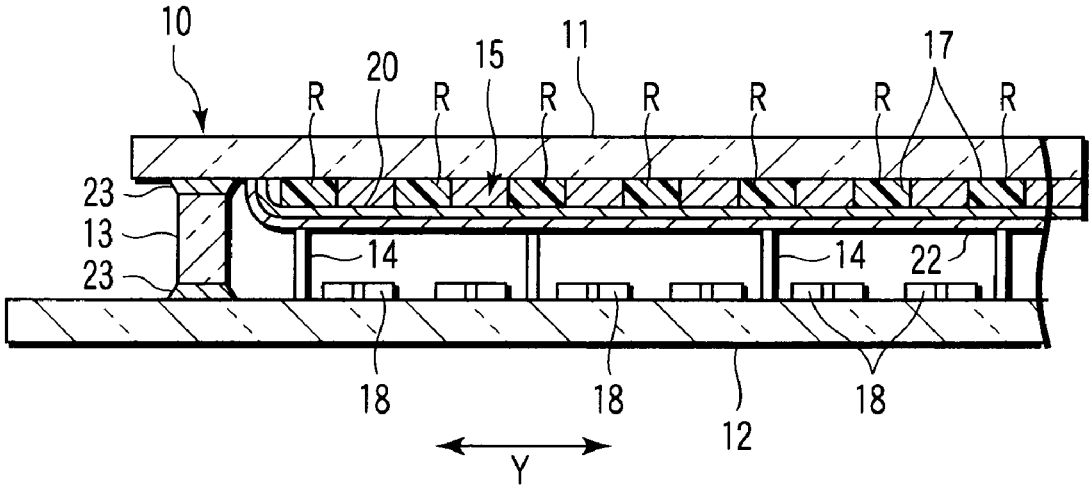
FIG. 2 is a sectional view of the FED, taken along line II-II shown in FIG. 1.

As shown in FIGS. 1 and 2, an FED according to an embodiment comprises a front substrate 11 and a rear substrate 12. The substrates are opposed, spaced part from each other by a gap of 1 to 2 mm. The front substrate 11 and the rear substrate 12 are coupled together, at their peripheral edges, with a rectangular frame-shaped side wall 13 interposed between them. The substrates therefore form a flat, rectangular vacuum envelope 10, the interior of which is maintained at a high vacuum of about $10^{-4}$ Pa. The side wall 13 is sealed to the peripheral edges of the front substrate 11 and those of the rear substrate 12, by a sealing member 23 made of, for example, low-melting glass, low-melting metal, or the like. The side wall 13 therefore connects the substrates to each other.

A phosphor screen 15 is formed on the inner surface of the front substrate 11. The phosphor screen 15 has phosphor layers R, G and B and a matrix-shaped light-shielding layer 17. The phosphor layers can emit red light, green light and blue light. On the phosphor screen 15, a metal-back layer 20 is formed. The metal-back layer 20 is made mainly of aluminum and functions as an anode electrode. A getter film 22 is laid on the metal-back layer 20. A predetermined anode voltage is applied to the metal-back layer 20 so that the FED may display images. The structure of the phosphor screen will be described later in detail.

On the inner surface of the rear substrate 12, electron-emitting elements 18 of a surface-conduction type are provided. The elements 18 are sources of electrons and emit electron beams, which excite the phosphor layers R, G and B of the phosphor screen 15. The electron-emitting elements 18 are arranged in rows and columns such that each may correspond to one pixel. Each electron-emitting element 18 comprises an electron-emitting part and a pair of element electrodes. The element electrodes apply a voltage to the electron-emitting part. A number of lines 21 for driving the electron-emitting elements 18 are provided on the inner surface of the rear substrate 12, forming a matrix. Each line 21 has its ends extending outside the vacuum envelope 10.

A number of plate-shaped spacers 14 are arranged between the front substrate 11 and the rear substrate 12, supporting the substrates 11 and 12 against the atmospheric pressure applied to them. The spacers 14 extend in the lengthwise direction of the rear substrate 12, are arranged in the widthwise direction of the rear substrate 12 and are spaced from one another at predetermined intervals. The spacers 14 are not limited to plate-shaped ones. They may be shaped like pillars.

To make the FED display an image, the anode voltage is applied to the phosphor layers R, G and B through the metal-back layer 20. The anode voltage accelerates the electron beams emitted from the electron-emitting elements 18. Thus accelerated, the electron beams impinge on target phosphor layers R, G and B. The target phosphor layers R, G and B are thereby excited and emit light. As a result, the FED displays an image.

Figure 3:
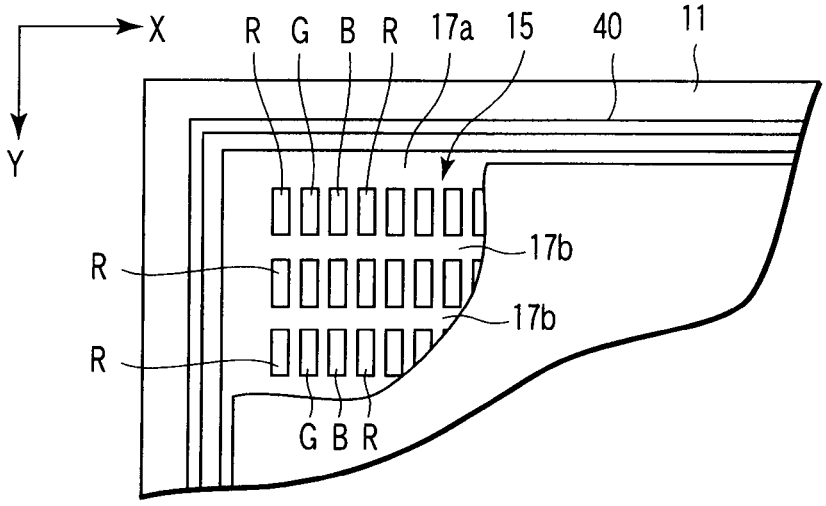
FIG. 3 is a plan view of the phosphor screen on the front substrate of the FED.

The configuration of the front substrate 11 will be described in detail. As FIG. 3 shows, the phosphor screen 15 has many strip-shaped phosphor layers R, G and B that can emit red light, green light and blue light. The FED may have a screen that is longer in the horizontal direction than in the vertical direction. In this case, the major-axis direction and the minor-axis direction are the first direction X and the second direction Y, respectively. Then, the phosphor layers R, G and B are repeatedly arrange in the first direction X and spaced at preset intervals, and phosphor layers of the same color are arranged in the second direction Y and spaced at preset intervals. The phosphor layers R, G and B have been formed by a known method, such as screen printing or photolithography. The light-shielding layer 17 has a rectangular frame part 17*a* and a matrix part 17*b*. The frame part 17*a* extends along the peripheral edges of the front substrate 11. The matrix part 17*b* lies in the spaces between the phosphor layers R, G and B.

The pixels (each composed of three phosphor layers R, G and B) are shaped like a square and arranged at a pitch of, for example, 600 μm, which will be used as a reference dimensional value in specifying the sizes of the other components of the FED.

Figure 4:
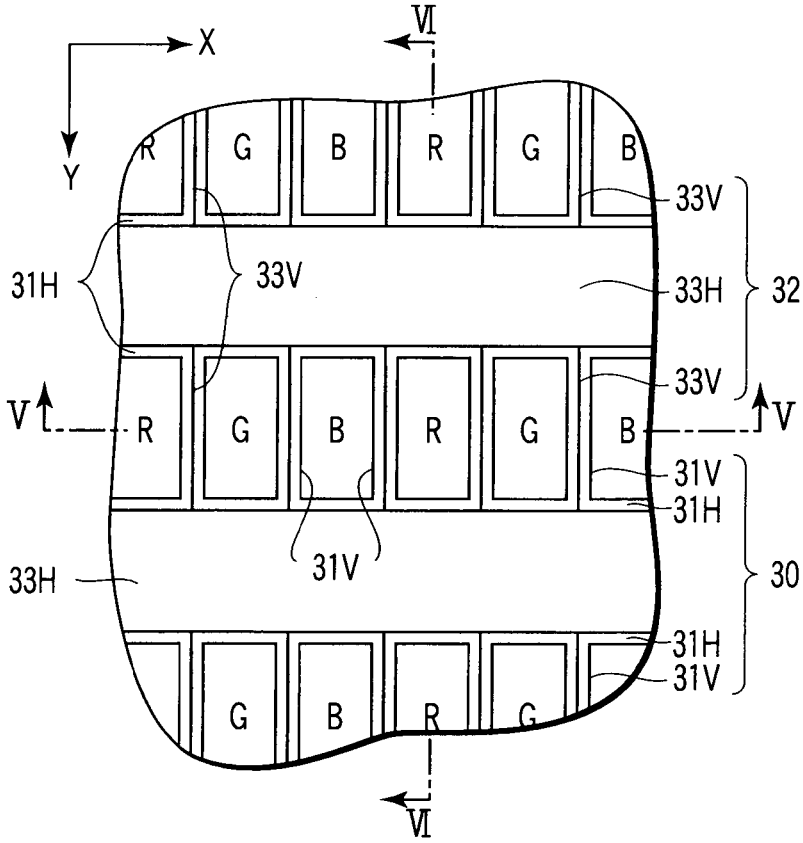
FIG. 4 is a magnified plan view showing the phosphor screen and resistance-adjusting layer of the FED.
Figure 5:
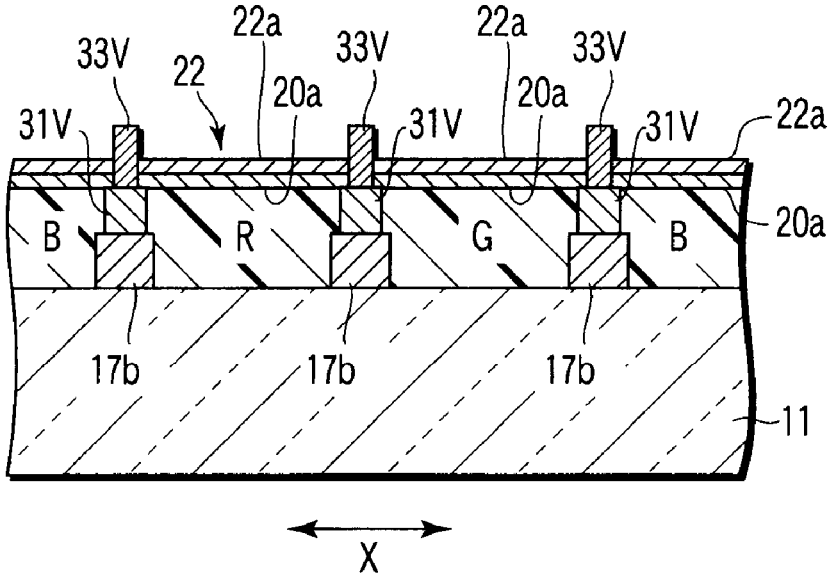
FIG. 5 is a sectional view of the phosphor screen etc., taken along line V-V shown in FIG. 4.
Figure 6:
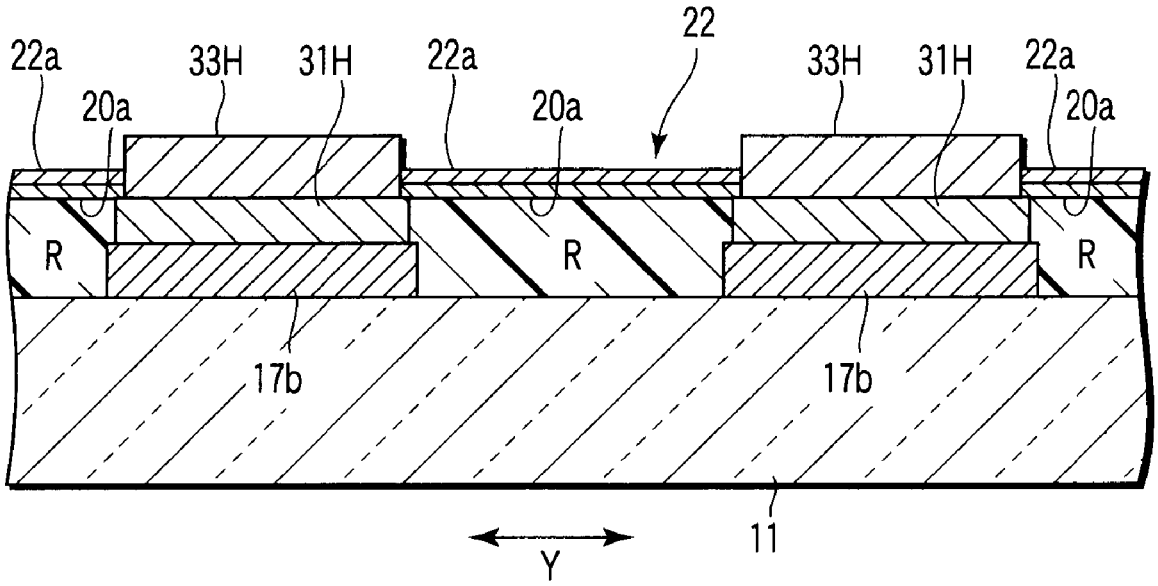
FIG. 6 is a sectional view of the phosphor screen etc., taken along line VI-VI shown in FIG. 4.

As shown in FIGS. 4 to 6, a resistance-adjusting layer 30 is formed on the light-shielding layer 17. The layer 30 has first resistance-adjusting layers 31V and second resistance-adjusting layers 31H, which are provided on the matrix part 17*b* of the light-shielding layer 17. The first resistance-adjusting layers 31V extend in the second direction Y and lie between the phosphor layers that are spaced in the first direction X. The second resistance-adjusting layers 31H extend in the first direction X and lie between the phosphor layers that are spaced in the second direction Y. Since the phosphor layers R, G and B forming any pixel are arranged in the first direction X in the order they are mentioned, the first resistance-adjusting layers 31V are much narrower than the second resistance-adjusting layers 31H. For example, the first resistance-adjusting layers 31V are 40 μm wide, while the second resistance-adjusting layers 31H are 300 μm wide.

A thin-film-dividing layer 32 is formed on the resistance-adjusting layer 30. The layer 32 has vertical-line parts 33V and horizontal-line parts 33H. The vertical-line parts 33V are formed on the first resistance-adjusting layers 31V of the resistance-adjusting layer 30, respectively. The horizontal-line parts 33H are formed on the second resistance-adjusting layers 31H of the resistance-adjusting layer 30, respectively. The thin-film-dividing layer 32 is made of a binder and particles. The particles are dispersed in such an appropriate density that the layer 32 has projections and depression on and in the surface. The projections and the depressions will divide any thin film that may be formed on the thin-film-dividing layer 32 by means of vapor deposition or the like. The components of the layer 32 are a little narrower that those of the light-shielding layer 17. For example, the horizontal-line parts 33H are 260 μm wide, and the vertical-line parts 33V are 20 μm wide.

After the thin-film-dividing layer 32 has been formed, a smoothing process is performed, using a lacquer or the like, in order to form the phosphor layers. The film used in the smoothing process will be burnt out after the metal-back layer 20 has been formed. The smoothing process is well known in the art, and is employed in manufacturing CRTs or the like. The process is carried out in such conditions that the thin-film-dividing layer 32 is never smoothed.

After the smoothing process, a thin-film forming process such as vapor deposition is performed, forming a metal-back layer 20 on the phosphor layers R, G and B and the thin-film-dividing layer 32. The thin-film-dividing layer 32 divides the metal-back layer 20 in the first direction X and the second direction Y, into metal-back segments 20*a*. The metal-back segments 20*a* overlap the phosphor layers R, G and B, respectively. In this case, the gap between any adjacent metal-back segments 20*a* is almost the same as the width of the horizontal-line parts 33H of the thin-film-dividing layer 32 and the width of the vertical-line parts 33V thereof. That is, the gap is 20 μm in the first direction X and 260 μm in the second direction Y.

Further, a getter film 22 is formed on the metal-back layer 20. In the FED, the getter film 22 is provided on the phosphor screen in order to maintain a sufficient degree of vacuum for a long time. As in most cases, the getter film 22 can no longer perform its function once it has been exposed to the atmosphere. To avoid this, the getter film 22 is formed by a thin-film process, such as vapor deposition, when the front substrate 11 and the rear substrate 12 are fused together in a vacuum. Even after the metal-back layer 20 has been formed, the thin-film-dividing layer 32 can perform its function of dividing the metal-back layer 20. Therefore, the film-dividing layer 32 divides the getter film 22, too, into getter-film segments 22*a* in the same pattern as the metal-back layer 20. The getter film 22 is made of an electrically conductive metal, as in most cases. Nonetheless, the metal-back segments 20*a* are prevented from being electrically connected to one another, because no getter-film segments 22*a* are separated from one another.

In the manufacturing method described above, getter-film segments 22*a* are formed, which are separated by gaps Gxg 20 μm wide in the X direction and by gaps Gyg 260 μm wide in the Y direction.

X and Y in this invention will be defined as follows. Consider an FED of the ordinary type, which has a screen longer in the horizontal direction than in the vertical direction. Here, the major-axis direction and the minor-axis direction will be explained as X direction X and Y direction Y, respectively. In a typical configuration, a plurality of scanning lines extend in the X direction, and a plurality of modulation lines extend in the Y direction. Thus, the scanning lines and the modulation lines form a matrix. The scanning and modulation lines perform so-called simple-matrix driving. That is, the scanning lines are sequentially applied with a scanning voltage, shifting in the Y direction, each time for, for example, 1/60 sec. While each scanning line is being applied with the scanning voltage, a modulation signal for the pixel corresponding to the scanning line is supplied to the modulation line. In view of the current (i.e., beam current) supplied to the front substrate, a current must be supplied to many pixels corresponding to the scanning line, at the same time, if power is supplied in the X direction. Inevitably, the operating efficiency is low. It is therefore better to supply power in the Y direction, in view of the power-supplying efficiency. The X direction and the Y direction referred to in the present embodiment are based on such technical background. Hence, the scanning direction of the ordinary definition is the X direction, while the direction at right angles to the scanning direction of the ordinary definition is the Y direction.

Figure 7:
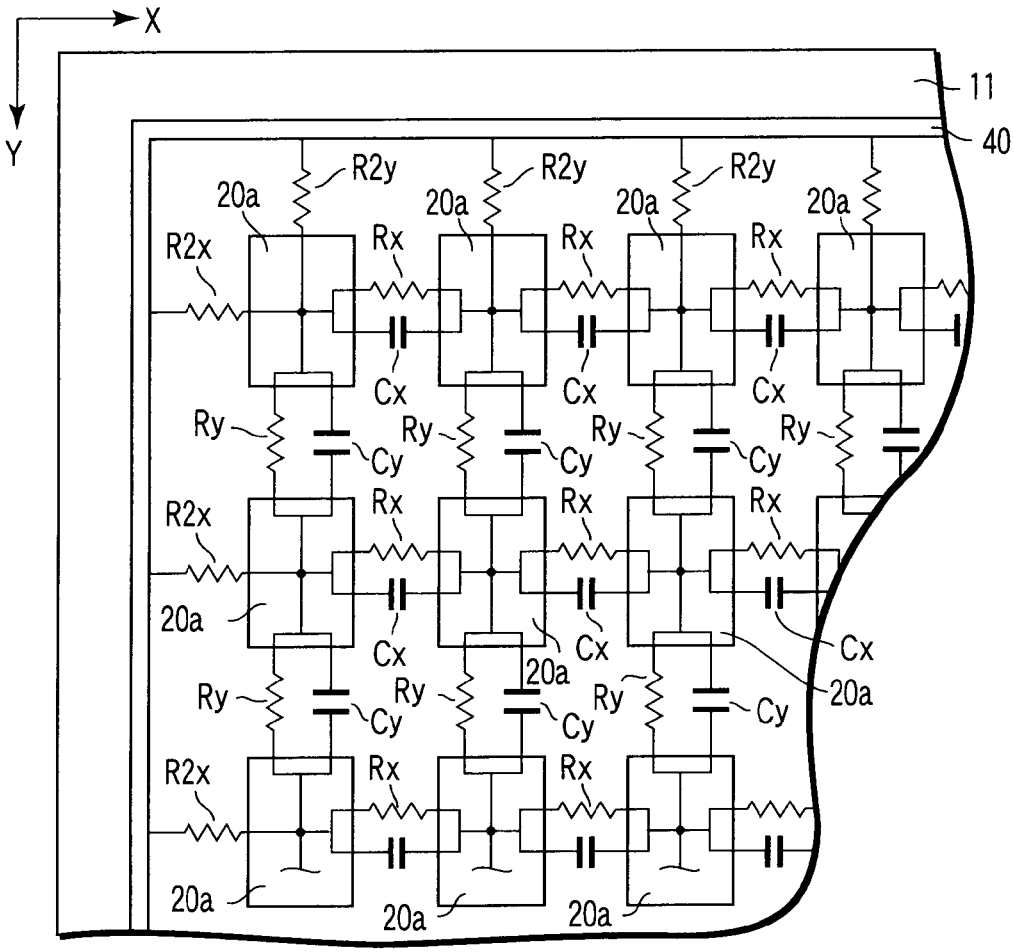
FIG. 7 is a plan view showing the front substrate and equivalent circuit of the FED.

FIG. 7 shows an equivalent circuit of the front substrate 11. The metal-back segments 20*a* arranged in the first direction X are connected by the first resistance-adjusting layers 31V. A resistor Rx and a capacitor Cx are formed between any adjacent metal-back segments 20*a* that are arranged in the first direction X. The metal-back segments 20*a* arranged in the second direction Y are connected by the second resistance-adjusting layers 31H. A resistor Ry and a capacitor Cy are formed between any adjacent metal-back segments 20*a* that are arranged in the second direction Y.

On the inner surface of the phosphor screen 15, a common electrode 40 is formed, which extends along the four sides of the front substrate 11. Of the metal-back segments 20*a*, those that are arranged in the second direction Y at the outer peripheral edges of the front substrate 11 are electrically connected to the common electrode 40 by connecting resistors R2*x* that extend in the first direction X. The metal-back segments 20*a* that are arranged in the first direction X at the outer peripheral edges of the front substrate 11 are connected to the common electrode 40 by connecting resistors R2*y* that extend in the second direction Y. The common electrode 40 is connected to an external high-voltage source by a high-voltage applying means (not shown).

The present embodiment is based on the voltage-dependency of resistance. As far as the research of the inventors hereof is concerned, the resistive member used had its resistance changed in accordance with the voltage applied to it. To illustrate this voltage-dependency, Rx, for example, will be expressed as Rx(V), which is a function of the voltage V. In most cases, R(V) seems to be the decrease function of V.

The inventors hereof studied the reduction of discharge current, the supply of power (to control the decrease in luminance) and the suppression of discharge between the metal-back segments, all mentioned above. They found it advantageous to render Ry(V) a more moderate function than Rx(V). This point will be explained below in detail.

Rx and Ry influence the discharge current to almost the same degree. During the discharge, the voltages applied to Rx and Ry gradually increase to, for example, hundreds of volts to thousands of volts. Hence, the values of Rx and Ry are very important at high voltages. The larger Rx and Ry, the more greatly the conduction by virtue of capacitances Cx and Cy will influence the current. Therefore, the influence on the discharge current will decrease. On the other hand, Ry contributes more to the supply of power than Rx. Even in the normal operating state, where no discharge takes place, the voltage applied to Rx and Ry is at most in the order of 1V. The voltage applied to the dividing part increases as the discharge current changes. Therefore, this voltage is related to the discharge current at great values. However, since the voltage applied to the dividing part changes less after the current has abruptly increased, it differs from the discharge current in connection with the contribution of Cx and Cy.

In the case where the voltage-dependency is not taken into consideration, the following will be desired. For the supply of power, it is advantageous to decrease Ry and decrease Rx as much as possible in view of the supply of power, and to increase both Rx and Ry in view of the suppression of discharge current. In view of the reduction in the voltage between the metal-back segments, it is desirable to decrease both Rx and Ry as much as possible. Nevertheless, Rx should be lower, because the gap between any adjacent metal-back segments arranged in the X direction is smaller than the gap between any adjacent metal-back segments arranged in the Y direction. This trade off inevitably determines the degree the discharge current can be reduced.

In consideration of the voltage-dependency, the following can be said. Ry tends to decrease in view of the supply of power. Hence, Ry will greatly increase the current if Ry(V) decreases greatly due to V. It is desired for Rx to be higher by the value the Ry has decreased. If Rx thus becomes higher, however, Cx will come to the fore. Cx therefore contributes much in proportion to the increase in Rx. Thus, Rx contributes less to the increase in current, though it decreases greatly due to V. In view of this, it is advantageous to make Ry(V) a more moderate function than Rx(V).

In consideration of the voltage applied to the dividing part, Rx should be somewhat high if the voltage on the dividing part is low. Then, the increase in the discharge current can be suppressed. When Rx lowers thereafter, the voltage generated at the dividing part can be suppressed, while the increase in the current is controlled. This is why it is better if Rx(V) is an appropriate decrease function.

Indices for expressing the changes in the function will be explained. The voltage applied to Rx and Ry while power is being supplied is at most in the order of 1V. Therefore, the value the resistance has at 1V should be studied. At the time of discharge, a voltage of at least 100V is applied. Thus, consider the resistance at 100V. Let us determine the ratio between these voltages:

$$Kx=Rx(100)/Rx(1)$$

$$Ky=Ry(100)/Ry(1)$$

These are defined as indices. Ry(V) is a function more moderate than Rx(V). This means that the relation between the Kx and Ky can be generally expressed as follows, in view of the technical point described above:

$$Kx<Ky$$

In this embodiment, Rx(V) is determined by the first resistance-adjusting layers 31V, and Rx by the second resistance-adjusting layers 31H. The first resistance-adjusting layers 31V are thick-film resistors that have been formed by a printing material made mainly of resistive metal-oxide particles and containing a binder such as frit glass. The second resistance-adjusting layers 31H are thin-film resistors that have been formed by deposing and sputtering a low-resistance metal oxide. In this configuration, Kx is 0.3 and Ky is about 0.9. Generally, Kx and Ky are not limited to these values. Rather, they can have such values as will establish the above-mentioned relation. Then, they can be expected to achieve the advantages desired.

The inventors thereof made, on a trial basis, FEDs having the conventional configuration and examined them for Kx and Ky. In these FEDs, Kx=0.3 and Ky=0.2. The FEDs made on a trial basis were compared with the FED according to this embodiment. It was found that the FED according to this embodiment can increase the discharge current by 0.4 times.

In the embodiment described above, thin-film resistors are used in order to increase Ky in particular. Generally, even if thick-film resistors are used, the voltage-dependency changes in various ways, in accordance with the combination of the resistive material and binder that are used. Therefore, both types of resistance-adjusting layers may be thick-film resistors.

In the FED according to this embodiment, so configured as described above, the voltage-dependency of the resistance between any adjacent metal-back segments is so defined that the discharge current may be more reduced than in the conventional FED. The FED can therefore meet a severer tolerance-current specification. The items of performance, such as luminance, resolution and lifetime, can thereby be enhanced. Further, the FED can be an image display apparatus that can be manufactured at low cost.

An FED according to a second embodiment according to the present invention will be described. The components identical to those of the first embodiment are designated by the same reference numbers and will not be described in detail.

Figure 8:
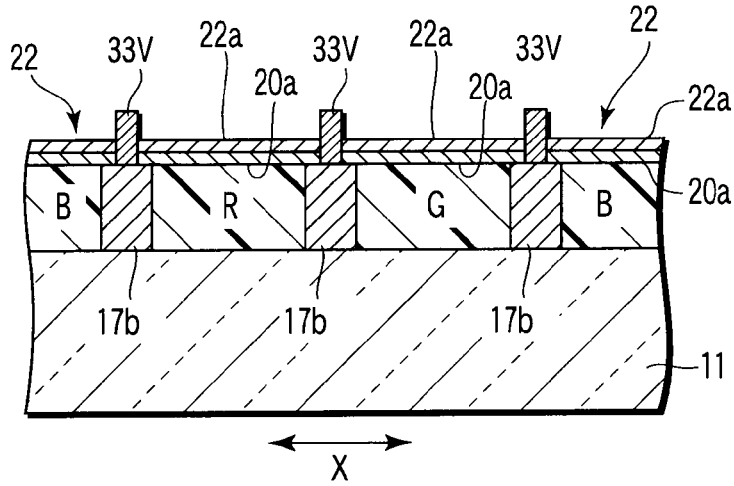
FIG. 8 is a sectional view showing the phosphor screen etc. of an FED according to a second embodiment of the present invention.

As FIG. 8 shows, in the FED according to the second embodiment, the light-shielding layer 17 constitutes first resistance-adjusting layers and second resistance-adjusting layers. To achieve this, the first resistance-adjusting layers and the second resistance-adjusting layers have their resistances adjusted to appropriate values in the same way as in the first embodiment, and the light-shielding layer is made of material that is almost black and has a low reflectance. Therefore, the process can be simplified, and the yield can be increased. Ultimately, the manufacturing cost can be reduced.

In the embodiment described above, the resistance-adjusting layer 30 is matrix-shaped, in conformity with the matrix part of the light-shielding layer 17. Instead, each second resistance-adjusting layer 31H, for example, may be provided for two lines of pixels. Each first resistance-adjusting layer 31V may be provided for one pixel if each pixel is composed of three phosphor layers R, G and B. In this configuration, the number of segments into which the metal-back layer 20 is divided can be reduced, which is desirable for the purpose of increasing the manufacture yield. The pitch at which the layer 20 is divided can of course be of any value that falls within such a range that helps to achieve the object.

In the embodiment described above, the FED is one that has a getter film. Nevertheless, an FED may have no getter films. If this is the case, Rx and Ry are defined by the gaps Gx and Gy between the metal-back segments, not the gaps Gxg and Gxg between the getters. Strictly speaking, Rx and Ry may be influenced by not only the resistance-adjusting layers. They are influenced by the thin-film dividing layer, too, to some extent. Therefore, if a getter film is provided, Rx and Ry are resistance values that are achieved after the getter film has been formed.

This invention is not limited directly to the embodiment described above, and its components may be embodied in modified forms without departing from the scope or spirit of the invention. Further, various inventions may be made by suitably combining a plurality of components described in connection with the foregoing embodiments. For example, some of the components according to the foregoing embodiments may be omitted. Furthermore, components according to different embodiments may be combined as required.

The gaps between the metal-back segments, as defined in this specification, are not limited to those that are provided by removing parts of the metal-back layer. They may be provided by dividing the metal-back layer by such a thin-film dividing layer, or by changing parts of the metal-back layer in nature, thus increasing the resistivity. The various components are not limited, in terms of size and material, to those specified above in junction with the embodiments. Their sizes and materials can be changed, as is needed.

What is claimed is:

1. An image display apparatus comprising:

a front substrate which has a plurality of phosphor layers, resistor layers provided between the phosphor layers, a metal-back layer divided into a plurality of metal-back segments covering the phosphor layers and resistor layers at least in part, and spaced apart by gaps Gx in a first direction X intersecting at right angles with a scanning direction and by gaps Gy in a second direction Y identical to the scanning direction, and a voltage-applying means for applying a voltage on the metal-back segments; and a rear substrate which is opposed to the front substrate and on which a plurality of electron-emitting elements are arranged;

wherein $Rx(100)/Rx(1)<Ry(100)/Ry(1)$, where Rx(V) is a resistance between any two of the metal-back segments on the sides of one of the gaps Gx, respectively, which is a function of a voltage V, and Ry(V) is a resistance between any two of the metal-back segments on the sides of one of the gaps Gy, respectively, which is a function of the voltage V.

2. The image display apparatus according to claim 1, wherein the plurality of phosphor layers are arranged at a specific pitch in the first direction X and at another specific pitch in the second direction Y, and the front substrate has a light-shielding layer formed surrounding each of the phosphor layers and a thin-film dividing layer laid on the light-shielding layer.

3. An image display apparatus comprising:

a front substrate which has a plurality of phosphor layers, resistor layers provided between the phosphor layers, a metal-back layer divided into a plurality of metal-back segments covering the phosphor layers and resistor layers at least in part, and spaced apart by gaps Gx in a first direction X intersecting at right angles with a scanning direction and by gaps Gy in a second direction Y identical to the scanning direction, a getter layer divided into a plurality of getter-layer segments spaced apart by gaps Gxg in the first direction and by gaps Gyg in the second direction, and a voltage-applying means for applying a voltage on the metal-back segments; and a rear substrate which is opposed to the front substrate and on which a plurality of electron-emitting elements are arranged;

wherein $Rxg(100)/Rxg(1)<Ryg(100)/Ryg(1)$, where Rxg(V) is a resistance between any two of the getter-layer segments on the sides of one of the gaps Gxg, respectively, which is a function of a voltage V, and Ryg(V) is a resistance between any two of the getter-layer segments, respectively, on the sides of one of the gaps Gyg, which is a function of the voltage V.

4. The image display apparatus according to claim 3,wherein the plurality of phosphor layers are arranged at a specific pitch in the first direction X and at another specific pitch in the second direction Y, and the front substrate has a light-shielding layer forming surrounding each of the phosphor layers and a thin-film divided layer laid on the light-shielding layer and dividing at least one of the metal-back layer and the getter film.

* * * * *